US006179619B1

(12) United States Patent
Tanaka

(10) Patent No.: US 6,179,619 B1
(45) Date of Patent: Jan. 30, 2001

(54) GAME MACHINE FOR MOVING OBJECT

(76) Inventor: Shigenobu Tanaka, 336-1-707 Hisasue, Takatsu-ku, Kawasaki-shi, Kanagawa, 213-0026 (JP)

( * ) Notice: Under 35 U.S.C. 154(b), the term of this patent shall be extended for 0 days.

(21) Appl. No.: 09/214,786

(22) PCT Filed: May 12, 1998

(86) PCT No.: PCT/JP98/02098

§ 371 Date: Jan. 12, 1999

§ 102(e) Date: Jan. 12, 1999

(87) PCT Pub. No.: WO98/51385

PCT Pub. Date: Nov. 19, 1998

(30) Foreign Application Priority Data

May 13, 1997 (JP) ..... 9-137418

(51) Int. Cl.[7] ..... G09B 9/05

(52) U.S. Cl. ..... 434/69; 434/62; 434/307 R; 472/60; 463/30

(58) Field of Search ..... 434/29, 38, 43, 434/55, 62, 69, 307 R, 308, 365, 66, 60, 59; 472/43, 59–61, 65, 130, 131; 463/30, 32; 104/53, 55, 76, 85; 348/54, 115, 121, 123; 345/7, 8, 302, 355, 139, 425; 340/971, 980; 273/148 B

(56) References Cited

U.S. PATENT DOCUMENTS

| | | | | |
|---|---|---|---|---|
| 3,991,485 | * | 11/1976 | Golenski | 434/66 |
| 4,028,725 | * | 6/1977 | Lewis | 348/115 |
| 4,315,241 | * | 2/1982 | Spooner | 340/980 |
| 4,984,179 | * | 1/1991 | Waldern | 345/355 |
| 5,006,072 | * | 4/1991 | Letovsky et al. | 434/69 X |
| 5,322,441 | * | 6/1994 | Lewis et al. | 434/69 X |
| 5,336,132 | * | 8/1994 | Murakami | 472/60 X |
| 5,403,238 | * | 4/1995 | Baxter et al. | 472/59 X |
| 5,490,784 | * | 2/1996 | Carmein | 434/55 |
| 5,495,576 | * | 2/1996 | Ritchey | 345/425 |
| 5,584,697 | * | 12/1996 | Trumbull | 434/69 X |
| 5,662,523 | * | 9/1997 | Yasumaru et al. | 434/55 X |
| 5,669,821 | * | 9/1997 | Prather et al. | 472/60 X |

(List continued on next page.)

FOREIGN PATENT DOCUMENTS

| | | | |
|---|---|---|---|
| 0 468 340 A2 | | 1/1992 | (EP) . |
| 61-48786 | | 4/1986 | (JP) . |
| 2-15230 | | 4/1990 | (JP) . |
| 3-86187 | | 4/1991 | (JP) . |
| 6-218145 | | 8/1994 | (JP) . |
| WO 93/16776 | * | 2/1993 | (WO) ..... 434/307 R |

OTHER PUBLICATIONS

"Virtual Environment Display System" by Fisher et al, ACM 1986 Workshop on Interactive 3D Graphics, pp. 1–11, Oct. 1986.*

*Primary Examiner*—Joe H. Cheng
(74) *Attorney, Agent, or Firm*—Wenderoth, Lind & Ponack, L.L.P.

(57) ABSTRACT

A game machine for a moving object having both a position detecting device being operable to detect a position of a person riding on the moving object on a course of movement to obtain position information and a direction detection device being operable to detect a direction of a field of vision of the person to obtain direction information. The game machine also has a memory being operable to store visual and auditory information regarding a change in the course of movement and a central processing part being operable to select visual and auditory information corresponding to the position of the person and the direction of the field of vision of the person riding on the moving object based on the position information of the position detection device and the direction information of the direction detection device. A speaker and a display are used to output the selected auditory and visual information, respectively.

8 Claims, 4 Drawing Sheets

U.S. PATENT DOCUMENTS 5,707,237 * 1/1998 Takemoto et al. ..... 434/69
5,716,281 * 2/1998 Dote ..... 472/60
5,807,114 * 9/1998 Hodges et al. ..... 434/69 X
5,846,134 * 12/1998 Latypov ..... 434/55 X
5,921,780 * 7/1999 Myers ..... 434/69
5,954,508 * 9/1999 Lo et al. ..... 434/69 X

* cited by examiner

GAME MACHINE FOR MOVING OBJECT

BACKGROUND OF THE INVENTION

This invention relates to a game machine for moving objects, which enables a human operator to experience virtual reality.

In game establishments such as theme parks, a track travelling game machine adapted to move a vehicle along a course of movement such as, for example, a track furnished with curves and undulations, and to enable a human player on the vehicle to experience the sensation of a run at full speed and the sensation of exhilaration has formed a typical popular game machine. This game machine has been offered in various types such as keeping the human player in a standing position while in motion and keeping the human player in a position suspended from the track while in motion. A game machine of another type is adapted to advance a moving object along a channel of a fluid and enable a human player thereon to enjoy the delightful view of backgrounds and buildings laid out in a vicinity of the channel.

Further, in recent years, the game machine of yet another type adapted to move a seat as synchronized with an image and to integrate the image with the experience of the acceleration and deceleration of the speed of the seat enabling the occupant of the seat to experience the simulation of the movement of his seat, has been proposed. The game machine of this type is also known in various versions such as solely utilizing the occupancy by a human player, conferring the propensity for a game by combining the movement of a seat with the sensation of shooting, and so on (as disclosed in JP-B-02-15,230, for example).

The former version, however, has been at a disadvantage since it quickly ceases to hold lasting interest because of the use of a fixed course of movement which is devoid of visual variations. Since an effort to revive the game machine from the boredom by changing the course of movement or altering the peripheral facilities requires a large expense, this version does not easily permit such alterations to be made in short cycles from the viewpoint of business.

The latter version indeed permits such alterations to be implemented quickly and inexpensively because it allows the experience in simulation to be differentiated by simply altering the software, namely, the mode of moving the image and the seat. It nevertheless has had the problem of producing no sensation of the acceleration and deceleration of speed because it does not produce as high a sensation of acceleration and deceleration of speed as the former version. Further, the letter version suffers because the gravity actually sensed by the human player in his body to produce a sensation of discrepancy from the artificially generated gravity does not occur. The latter version has been further at a disadvantage in generating the same sensation of discrepancy with respect to the pressure of the wind which the human player experiences while the seat is in motion.

This invention has for an object thereof the provision of a game machine for a moving object, which enables an operator to differentiate his experience in simulation by making an arbitrary selection from the information on various courses of experience of simulation prepared in advance without requiring any alteration in the curves or undulations of the course of movement and also enables the operator to make an experience approximating as closely to reality as possible by properly providing him with an image conformity with his sensation of acceleration and deceleration of speed and the bearing of his body relative to the direction of the movement of the chair.

SUMMARY OF THE INVENTION

To accomplish the object described above, this invention contemplates a game machine for a moving object, which is provided with position detecting means for detecting the position of a human player occupying the moving object on the course of movement, memory means for storing the visual and auditory information associated with a change in the course of movement, means for selecting the visual and auditory information based on the information emanating from the position detecting means, and means for outputting and displaying the selected visual and auditory information.

The invention further contemplates a game machine for a moving object, which is provided with position detecting means for detecting the position of a human player occupying the moving object on the course of movement, direction detecting means for detecting the direction of the field of vision of the human player, memory means for storing the visual and auditory information associated with a change in the course of movement, means for selecting the visual and auditory information based on the information emanating from the position detecting means and the direction detecting means, and means for outputting and displaying the selected visual and auditory information.

The game machine is further provided with input means capable of being operated by the human player.

The game machine for the moving object described above is capable of storing preparatorily in the memory means thereof the visual and auditory information for developing a story in connection with a change in the course of movement. It, therefore, allows the story to be readily altered by changing the visual and auditory information. The game machine of the version which is provided with the input means is capable of storing a plurality of stories in advance and consequently enabling the human player to make an arbitrary selection from the collection of stories. Further, the use of this input means allows the human player to play a game.

This game machine detects the position of the human player on the course of movement with the aid of the position detecting means, selects from the memory means mentioned above the visual and auditory information proper for the position of the human player on the course of movement on the basis of the information on position derived from the position detecting means, and transmits the selected visual and auditory information to the output display means. When the game machine happens to be additionally provided with the direction detecting means, which is capable of detecting the direction of the human player's field of vision, it selects from the memory means mentioned above the visual and auditory information proper for the position of the human player on the course of movement and the direction of the human player's field of vision on the basis of the information on the direction derived from the direction detecting means and the information on the position derived from the position detecting means and transmits the selected visual and auditory information to the output display means. Then, the output display means outputs and displays the image and the sound on the basis of the visual and auditory information to be received from time to time.

DETAILED DESCRIPTION OF THE INVENTION

Now, one mode for embodying this invention will be described in detail below with reference to the drawings annexed hereto.

Figure 1:
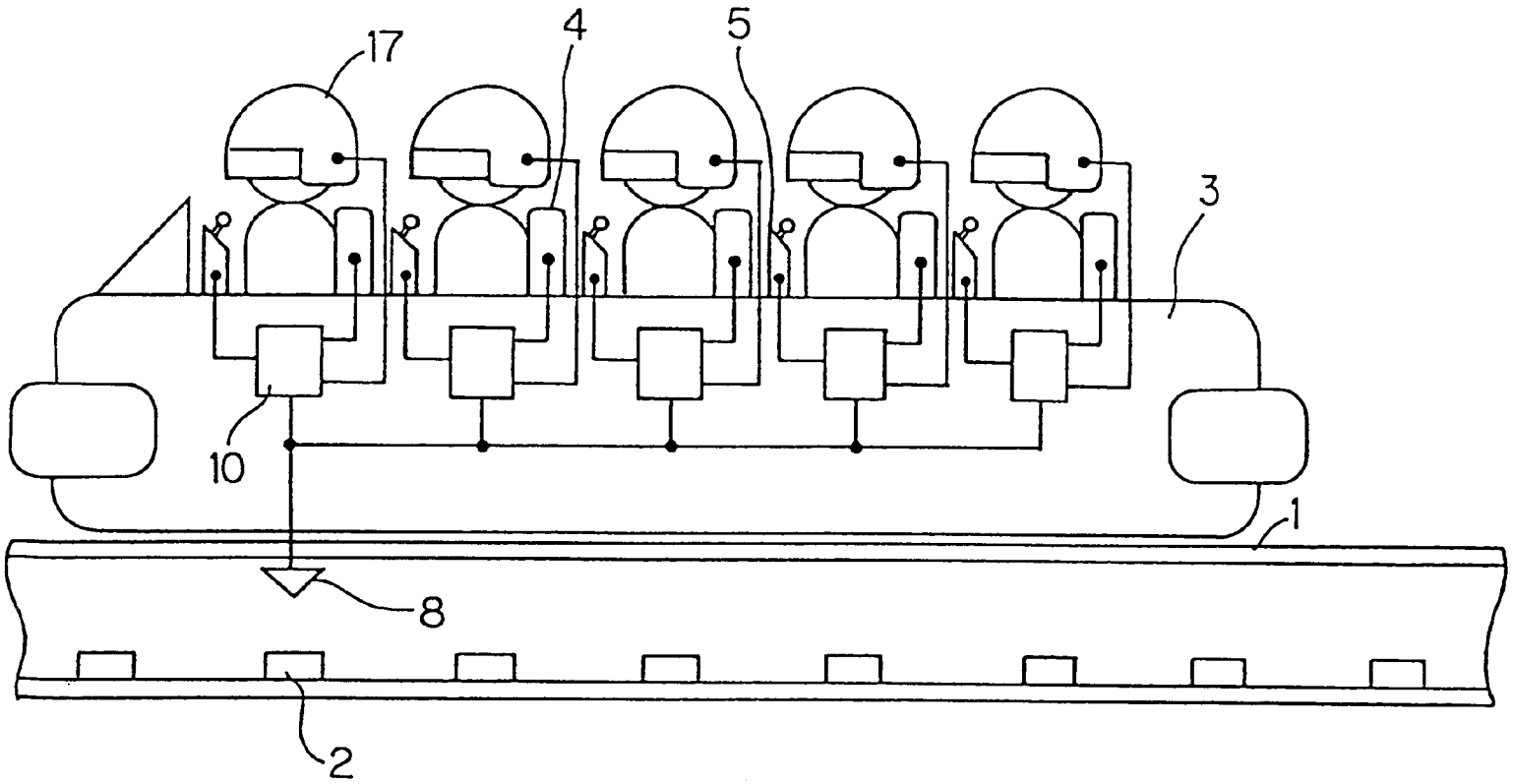
FIG. 1 is a schematic explanatory diagram illustrating one mode of embodying the game machine according to this invention.
Figure 2:
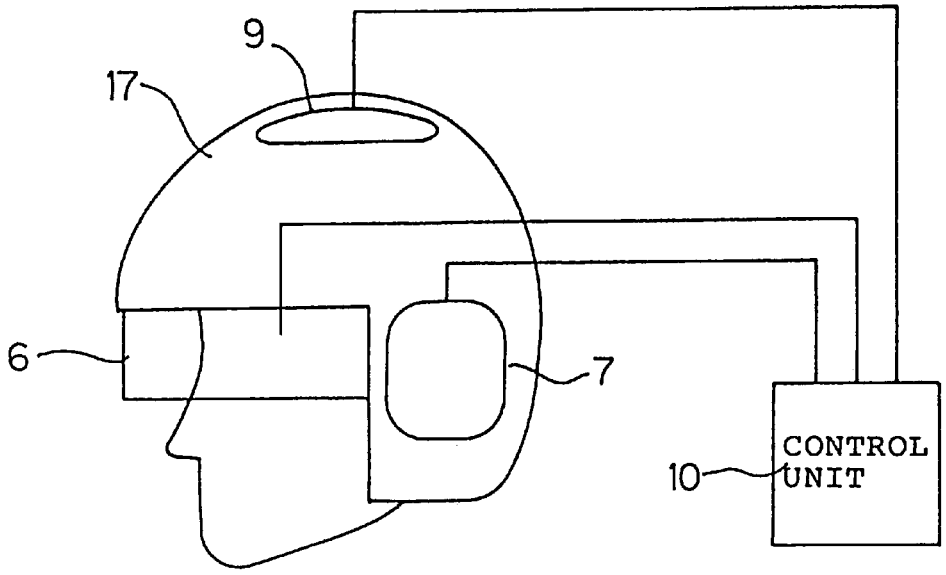
FIG. 2 is a schematic explanatory diagram illustrating part of the mode of embodying the present invention.

With reference to FIG. 1, 1 denotes an endless track provided with curves and undulations and destined to serve as a course of movement and 2 denotes each of a plurality of objects for detection intended for permitting detection of the position of a human player. Particularly, the objects 2 for detection are disposed invariably before and after a position at which the track 1 changes inclination or angle, for example, a point of rise or fall in an undulation or a curve. Besides the endless track 1, a waterway and a road may be cited as other examples of the course of movement.

Figure 3:
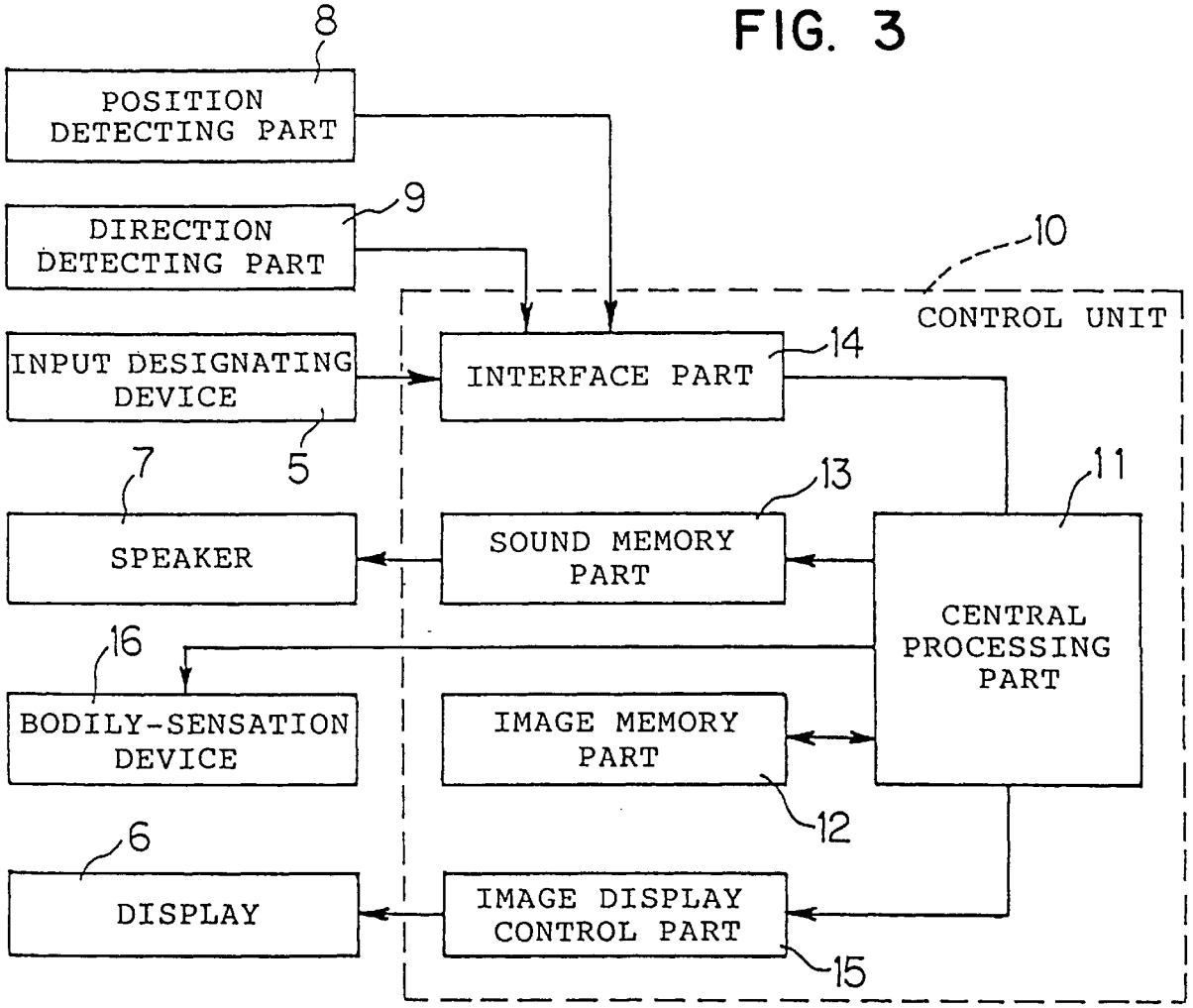
FIG. 3 is a block diagram illustrating a typical example of the construction of the control unit according to this invention.
Figure 4:
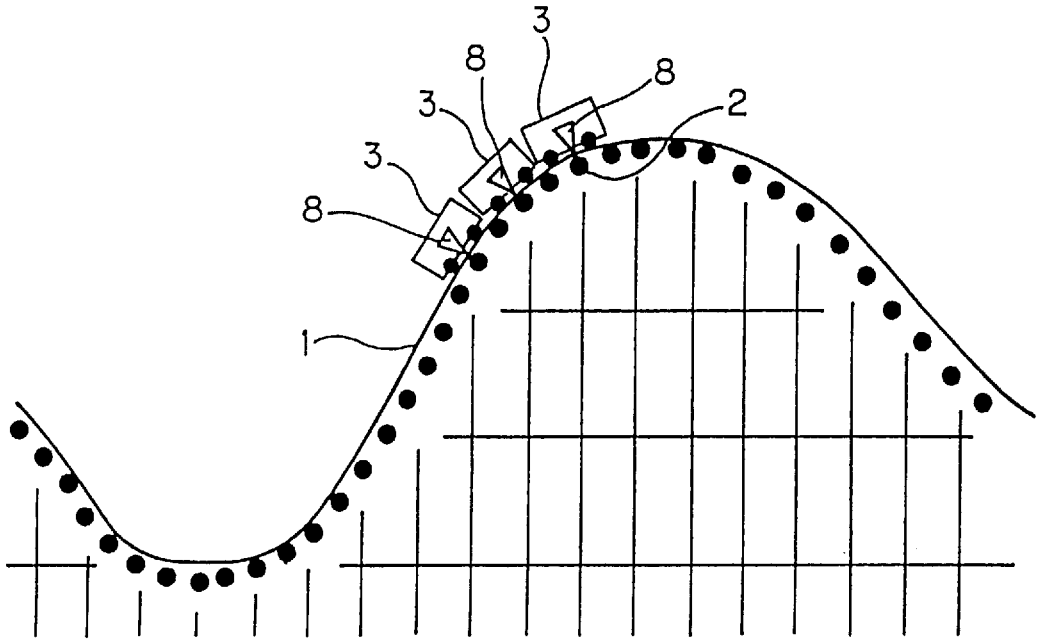
FIG. 4 is a schematic explanatory diagram illustrating the entirety of the game machine shown in FIG. 1.

Then, 3 denotes a moving object shaped like a ship and adapted to travel along the track 1. This moving object 3 is provided thereon with seats 4 capable of enabling respective human players thereon to experience vibration and other sensations to be exerted on their persons. The seats 4 are each provided with an input designating device 5 to be operated by the relevant human player, a display 6 for providing the relevant human player with an image, and a speaker 7 for providing the human player with a sound. Further, as illustrated in FIG. 3, an image memory part 12, a sound memory part 13, an interface part 14, and an image display control part 15 are connected to a central processing part 11 and, at the same time, control units 10 each having the input designating device 5, a position detecting part 8, and a direction detecting part 9 connected thereto through the medium of the interface part 14 are disposed quantitatively equally to the seats on the moving object.

The seat 4 is provided with a built-in bodily-sensation device 16 adapted to impart a stimulation such as vibration to the human player in accordance with the bodily-sensation information transmitted from the central processing part 11. By synchronizing the bodily-sensation information with the auditory information, the human player is able to experience a further exalted sensation of realism.

The input designating device 5 is an input means that enables a relevant human player to produce various manipulations for enjoying an experience of virtual reality such as a game or selecting the development of a story of the image put up on the display 6. When this device 5 is used for a game, for example, a shooting game, the human player is able to produce an operation of shooting at a target by manipulating a stick or a visual sensor adapted to pinpoint a cursor placed on the display 6 at the target and then depressing a button.

The display 6 and the speaker 7 are disposed on a helmet 17 which is worn on the human player's head. When the human player wears this helmet 17, the display 6 covers his eyes and the speaker 7 muffles his ears, with the result that the human player will be enabled to view an image put up on the display 6 through the medium of the image display control part 15 and hear a sound from the speaker 7. This display 6 is capable of showing different images to the opposite eyes of the human player and producing a three-dimensional image. The speaker 7 is capable of emitting a stereophonic sound. Thus, the helmet 17 enables the human player to appreciate the sensation of realism both visually and auditorially.

The image display control part 15 is adapted to synthesize image information, three-dimensional data, game data, etc. and places the result of the synthesis on the display 7. The image display control part 15, on electing to show a three-dimensional image, puts up a two-dimensional image to be viewed by the left eye, and a two-dimensional image to be viewed by the right eye respectively, of the human player.

The present embodiment contemplates disposing the display 6 and the speaker 7 on the helmet 17. This arrangement does not constitute a critical requirement for this invention. For example, the display may be in the form of goggles or may be fixed on the seat, and the speaker may be in the form of a headphone or may be fixed on the seat.

The position detecting part 8 is provided on the moving object 3 and is adapted to detect the objects 2 for detection laid out along the track 1 and transmit successively the information on the positions of the moving object 3 on the track 1 to the central processing part 11. A plurality of position detecting parts 8 may be provided, when necessary, one each for the seats 4 so that the positions of the human players on the track 1 may be respectively detected. In this case, the direction detecting part 9 detects the directions of the lines of vision, respectively, of the human players. The plurality of position detecting parts 8 may be disposed one each on the rows of seats 4 which perpendicularly intersect the direction of travel of the moving object 3. In this case, the direction detecting part 9 satisfactorily functions by detecting the directions of the lines of vision of the human players and the positions of the human players in the rows of seats 4 of the moving object 3. As another concrete example of the position detecting part, the global positioning system (GPS) which makes use of an artificial satellite may be utilized.

The direction detecting part 9 is disposed on the helmet 17 and is adapted to detect the direction of the line of vision of the human player wearing the helmet 17 and, at the same time, detect the position of the human player on the moving object 3 and transmit the information on the direction of the human player to the central processing part 11. As concrete examples of the direction detecting part 9, a device adapted for detecting and positioning the three-dimensional angle of the helmet 17 by properly combining a gyrosensor with an acceleration sensor and a device adapted for magnetically detecting the motion of the helmet 17 by causing the moving object 3 to generate a magnetic field may be utilized.

The central processing part 11 is adapted to transmit to the image display control part 15 the visual information and the three-dimensional data corresponding to the position of the human player on the track 1 and the direction of the line of vision of the human player based on the information on position and the information on direction acquired through the medium of the interface part 14, and also to transmit via the sound memory part 13 to the speaker 7 the auditory information corresponding to the visual information as synchronized with the visual information, and further to transmit to the bodily-sensation device 16, the information on the bodily sensation as synchronized with the auditory information. The image, three-dimensional data, and bodily-sensation information are stored in the image memory part 12, the auditory information is stored in the sound memory part 13, and the stored matters together constitute the contents which are associated with changes in the course of movement.

The memory parts 12 and 13, when necessary for the purpose of permitting the selection of courses of experience, may be adapted to memorize visual information of various developments and store such bodily-sensation information and auditory information as correspond to the visual information. Further, by altering the stored information, the game machine is enabled to provide entirely new images and sounds for the human player.

As concrete examples of the image memory part 12 and the sound memory part 13, ROM's and RAM's may be used. These devices may be suitably adapted for the storage of a program for specifying a procedure for the operation of the central processing part 11 and for the storage of such pieces of information to be processed by the central processing part 11. By using additional implements such as a reading device incorporating an optical disk therein as a memory medium and a magnetic memory device, which are not illustrated in the diagram, it is possible to prepare a large volume of visual and auditory information and permit storing in the image recording part 12 and the sound memory part 13 such information as is suitably required in conformity with the story selected by the human player and the position of the moving object 3. In this case, the reading device or the magnetic memory device will be precluded from being effected by the weather or vibration when it is installed at a place separated from the control unit 10 and adapted to effect necessary transmission or reception of the information by radio. It is allowable to utilize the reading device and the magnetic memory device jointly as a combination visual and auditorial part.

The embodiment, as described above, provides for one control unit 10 for each of the human players riding on the moving object 3. This invention, nevertheless, does not preclude installing the control unit 10 at a place other than the moving object 3 and further allowing the control unit 10 to exchange necessary information with wireless communication means (not shown) provided on the helmet 17 or the moving object 3. Alternatively, one control unit may be so adapted as to provide images and sounds to a plurality of human operators.

Now, the operation of the game machine for the moving object constructed as described above will be described below.

For a start, the image memory part 12 and the sound memory part 13 are caused in advance to store several patterns of stories that concern changes in the course of movement or a plurality of sets of images in the image memory part and a plurality of sets of sounds in the sound memory part having different stories stored in advance. As a concrete example of the information for the storage, a story of the environment in which a human player rides on an imaginary means of transportation and travels thereon through an unrealistic space may be cited. For this story, it is preferred to project an image of the moving object in motion corresponding to an inclination relative to a horizontal line in conformity with a curve in the course of movement, an image of the moving object plunging into a cloud or ground corresponding to a rise or a fall in the course of movement, and an image of the moving object passing a scene varying quickly or slowly in concert with the acceleration or deceleration of the moving object 3 to and also emit such sounds as those of a specific effect aimed at producing the sensation of speed and those of an impact aimed at producing the sensation of a plunge.

The story may further contemplate projecting an image moving faster than the real speed or an image moving slower than the real speed. By thus showing a fast moving image to human players that seek an exaggerated thrill and a slow moving image to infant and elderly human players, it is possible for any human player to select the degree of ease of ride (fearfulness) that befits his taste.

The human player first puts on the helmet 17 disposed at the seat 4 of his choice on the moving object 3, sits down on the seat 4, and selects a story fitting his taste with the aid of the input designating device 5. At this time, since the moving object 3 is still at rest, the direction detecting part 9 detects the position of the relevant human player on the moving object 3 and the direction of the line of vision of the human player and transmits the information on the position and the information on the direction to the central processing part 11 through the medium of the interface part 14. Then, the central processing part 11 derives from the chosen story, the visual information and the three-dimensional data corresponding to the direction of the line of vision of the human player based on these pieces of information and forwards them from the image memory part 12 to the image display control part 15, and the image display control part 15 places two two-dimensional images on the display so as to render the three-dimensional image visible. When the image to be displayed is accompanied by a sound, the central processing part 11 causes the sound memory part 13 to forward corresponding auditory information to the speaker 7.

When the moving object 3 is then begins moving, the position detecting part 8 disposed on the moving object 3 detects the object 2 for detection disposed on the track 1 and forwards the information on position corresponding to the position of the moving object 3 on the course of movement through the medium of the interface part 14 to the central processing part 11. Then, the central processing part 11 derives from the chosen story, the visual information corresponding to the position of the human player and the direction of the line of vision of the human player based on the information on the position and the information on the direction emanating from the direction detecting part 9, and forwards the pieces of information from the image memory part 12 to the image display control part 15. The central processing part N also reads an auditory information corresponding to the visual information, emits it through the speaker 7, forwards bodily-sensation data to the bodily-sensation device 16 disposed on the seat 4 which exerts a vibration corresponding to the image on the seat 4.

Even when multiple human players ride on the same moving object 3, images taking into account the positions of the individual human players on the moving object 3 are put up on the displays 6 assigned to the different human players. The different images, therefore, are displayed even when the human players have selected the same story and are keeping the lines of their vision in the same direction. Accordingly, the individual human players are able to view the images that are synchronized with their own actual experienced sensations of acceleration and deceleration and zero gravity and are consequently allowed to experience an unrealistic world in a state approximating closely to reality. Such human players are able not only to acquire a realistic experience of viewing a human player seated next to them, but also to acquire more realistically such an unrealistic experience of viewing a famous character seated next to themselves.

This invention, as described in detail above, contemplates providing a human player with the chance of experiencing a novel simulation by altering visual and auditory information and, therefore, enables the human player to acquire a constantly new experience of riding on a new means of transportation even when he actually repeats the ride on the same moving object. Thus, the invention is capable of securing a great number of repeat users. Further, since the renewal of the visual and auditory information is equivalent to the provision of a new game machine, the inevitable immense expenditures associated with new game machines can be greatly curtailed.

Further, the present invention can provide an simulation experience with exalted reality because it is capable of providing each of the human players with varying images and sounds that correspond to the choice of the relevant human player, the position of the human player on the moving object, and the direction of the line of vision of the human player.

What is claimed is:

1. A game machine, comprising:

a moving object to be occupied by at least one person, the moving object adapted to follow a course of movement;

a position detecting device adapted on the moving object being operable to detect a position of a person riding on the moving object on a course of movement to obtain position information;

a direction detection device being operable to detect a direction of a field of vision of the person to obtain direction information;

a control unit adapted on the moving object and connected to said direction detection device, said control unit comprising:

a memory being operable to store visual and auditory information regarding a change in the course of movement, and a central processing part being operable to select visual and auditory information corresponding to the position of the person and the direction of the field of vision of the person riding on the moving object based on the position information of said position detection device and the direction information of said direction detection device;

a speaker being operable to output the selected auditory information; and a display being operable to output the selected visual information.

2. A game machine for a moving object as claimed in claim 1, further comprising an input device being operable to allow the person to select a type of visual and auditory information, wherein said central processing part is operable to select visual and auditory information from the type of visual and auditory information corresponding to the position of the person and the direction of the field of vision of the person riding on the moving object based on the position information of said position detection device and the direction information of said direction detection device.

3. A game machine for a moving object as claimed in claim 1, further comprising an input device being operable to allow the person to input information, wherein said central processing part is operable to select visual and auditory information based on the information and corresponding to the position of the person and the direction of the field of vision of the person riding on the moving object based on the position information of said position detection device and the direction information of said direction detection device.

4. A game machine for a moving object as claimed in claim 1, wherein the course of movement is an endless track provided with curves and undulations.

5. A game machine for a moving object as claimed in claim 1, wherein the moving object is formed in the shape of a ship.

6. A game machine for a moving object as claimed in claim 1, wherein the moving object is provided with a plurality of seats for a plurality of people and corresponding pluralities of additional ones of said control unit, additional ones of said position detecting device, and additional ones of said direction detection device.

7. A game machine for a moving object as claimed in claim 6, wherein each of said plurality of seats is provided with a built-in bodily-sensation device being operable to impart stimulation, including vibration, to the person in accordance with bodily-sensation information from said central processing part.

8. A game machine for a moving object as claimed in claim 7, wherein the bodily-sensation information is synchronized with the auditory information.

* * * * *